US006552735B1

(12) United States Patent
Dehmlow

(10) Patent No.: US 6,552,735 B1
(45) Date of Patent: Apr. 22, 2003

(54) METHOD FOR ELIMINATING LATENT IMAGES ON DISPLAY DEVICES

(75) Inventor: Brian P. Dehmlow, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 224 days.

(21) Appl. No.: 09/654,313

(22) Filed: Sep. 1, 2000

(51) Int. Cl.[7] ..... G09G 3/36

(52) U.S. Cl. ..... 345/690; 345/46; 345/63; 345/72; 345/82; 345/83; 345/93; 345/204; 345/205; 345/207

(58) Field of Search ..... 345/46, 63, 72, 345/82, 83, 93, 204, 205, 207, 690

(56) References Cited

U.S. PATENT DOCUMENTS 4,928,182 A * 5/1990 Guerinot et al. ..... 348/818
5,291,295 A * 3/1994 Srivastava ..... 348/555
5,786,797 A * 7/1998 Kapoor et al. ..... 315/169.3
6,016,409 A * 1/2000 Beard et al. ..... 399/110
6,229,508 B1 * 5/2001 Kane ..... 345/205
6,252,606 B1 * 6/2001 Vaswani et al. ..... 345/441
6,313,816 B1 * 11/2001 Kojima et al. ..... 345/690
6,417,824 B1 * 7/2002 Tokunaga et al. ..... 345/60

* cited by examiner

*Primary Examiner*—Bipin Shawala
*Assistant Examiner*—Vincent E. Kovalick
(74) *Attorney, Agent, or Firm*—Nathan O. Jensen; Kyle Eppele

(57) ABSTRACT

A method of compensating for differential aging of independent emitters in a display is disclosed. According to the method, an image on the display is periodically sampled to determine how often each independent emitter is used. A history is compiled of the use of each independent emitter for a predetermined time. The amount of luminance decay that each independent emitter has experienced over the predetermined time is estimated. The maximum luminance of each independent emitter is adjusted so that the maximum luminances of all of the independent emitters is substantially the same as the maximum luminance of the independent emitter that has experienced the most decay.

11 Claims, 3 Drawing Sheets

METHOD FOR ELIMINATING LATENT IMAGES ON DISPLAY DEVICES

FIELD OF THE INVENTION

The present invention relates to display technology, and more particularly, to displays having a plurality of independently adjustable elements.

BACKGROUND OF THE INVENTION

Most light-emitting devices exhibit a permanent, irreversible decrease in light output as the device is operated. These decreases are usually related to chemical or physical changes in the material that emits light. Emissive displays, such as organic light-emitting diodes (OLED), are constructed using numerous independent emissive pixels, each of which will undergo its own time-related output decay. When the display is used with static or repetitive images, frequently used pixels will exhibit significantly greater output decay than pixels used infrequently. This situation is known as "differential aging". Pixels that are used frequently become dimmer than their unused neighbors. If the display image is then changed, the old image can sometimes be visible as a reduced brightness overlay on the new image. When past images become permanently incorporated into the display via differential aging, a "latent image" is said to appear. Latent images can cause considerable distraction to a display user, and may impair correct interpretation of the displayed images. Since display usage cannot be predicted or controlled, some means must be utilized to prevent latent images from becoming visible. It is not possible to completely eliminate the differential aging mechanism, so other means must be found to compensate for the effect. The need to compensate for differential aging is particularly acute for OLED displays. Other display technologies, such as electroluminescent (EL) and cathode-ray tube (CRT) displays, may also benefit.

It is therefore an object of the invention to correct the effect of latent images on a display such that any present latent image is not visible to the user.

A feature of the invention is the compensation for differential aging by adjusting the output of individual emissive elements of the display, based upon past usage of each of the display elements.

An advantage of the invention is that periodic sampling and adjustment of individual display elements mitigates the effects of latent images, and the useful life of a display is thereby extended.

SUMMARY OF THE INVENTION

The invention provides a method of compensating for differential aging of independent emitters in a display. According to the method, an image on the display is periodically sampled to determine how often each independent emitter is used. A history is compiled of the use of each independent emitter for a predetermined time. The amount of luminance decay that each independent emitter has experienced over the predetermined time is estimated. The maximum luminance of each independent emitter is adjusted so that the maximum luminances of all of the independent emitters is substantially the same as the maximum luminance of the independent emitter that has experienced the most decay.

The invention also provides a method of reducing the visibility of latent images on a display, wherein the display has a plurality of independently controllable pixels, According to the method, a controller is attached to the display. The controller is configured to receive display image data. The controller controls the luminance of each pixel based on the desired image. The image data is periodically sampled to determine whether each pixel is being used. A usage history of each pixel, comprising the results of a plurality of periodic samples of the image data, is stored in a memory. After a predetermined number of samplings, the luminance decay of each pixel is estimated based on the usage history of each pixel. The luminance of each pixel is adjusted so that the luminances of the plurality of pixels appear to have equal age-related decay.

The invention also provides a display control system that reduces the visibility of latent images on a display. The display has a plurality of independently controllable pixels. A controller is configured to receive periodic inputs that are representative of the use of each pixel. A memory is connected to the controller and is configured to store the periodic inputs as a usage history of each pixel. A processor is connected to the controller and estimates the luminance decay of each pixel based on the usage history for each pixel. The controller adjusts the luminance of each pixel so that the luminances of all of the plurality of pixels appear to have equal age-related decay.

DETAILED DESCRIPTION OF THE DRAWINGS

Figure 1:
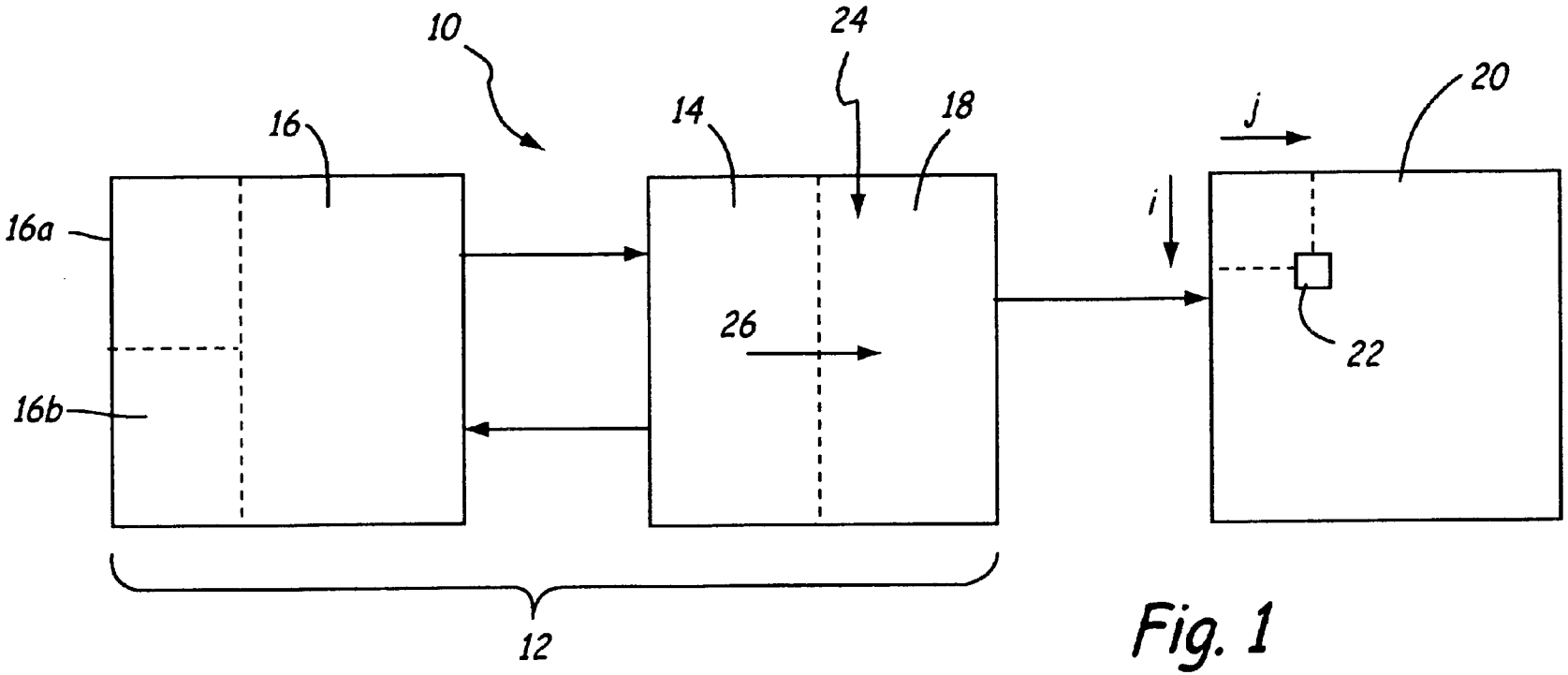
FIG. 1 is a schematic diagram of a system that eliminates latent images on a display.

FIG. 1 shows a schematic diagram of a system 10 according to the invention. A control unit 12 includes a processor 14, a memory 16, and a controller 18. Memory 16 includes a non-volatile memory 16*a* and a volatile memory 16*b*. Controller 18 is connected to a display 20. Display 20 includes a plurality of pixels or independent emitters, one of which is shown at 22. The independent emitters may be conveniently referred to in a Cartesian coordinate system having rows measured in direction i and columns measured in direction j. Controller 18 is configured to receive signals 24 from an external source (not shown). Alternately, controller 18 is configured to receive signals 26 from processor 14. Signals 24 and 26 are display image data that represent the desired image state of each pixel. Controller 18 is further configured to control the brightness of each pixel, as will be explained below.

Figure 2:
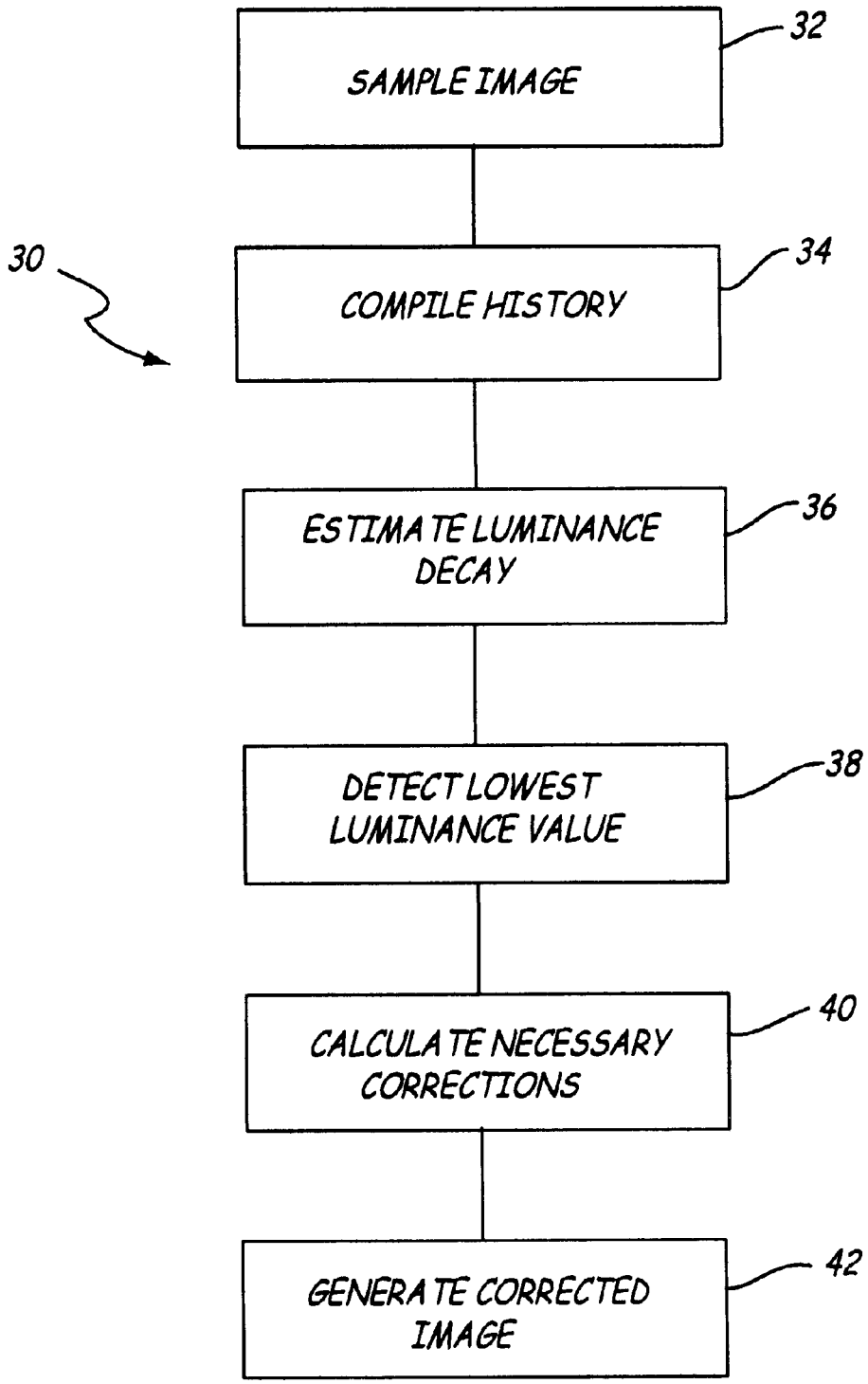
FIG. 2 is a flowchart of a method according to one embodiment of the invention.

FIG. 2 is a flowchart that discloses one method 30 according to the invention. According to method 30, in step 32 the image on display 20 is sampled. This may be performed by controller 18 periodically receiving signals 24 or 26 that are representative of the brightness, on/off status, or other status of each pixel. In step 34, controller 18 accumulates a history H of the status of each pixel and stores history H in memory 16. After the image has been sampled a predetermined number of times, in step 36 controller 18 estimates the luminance decay of each pixel based on the amount of use that each pixel has experienced. If the luminance decay is a function of the amount of use of each pixel, step 36 may be easily accomplished using history H. After the luminance decay of each pixel has been estimated, the lowest luminance value for any of the pixels is determined in step 38. The lowest luminance value represents the pixel that has been used most frequently during the predetermined time. Then, in steps 40 and 42, luminance corrections to each pixel are calculated and applied. The goal of these corrections is to equalize the maximum luminance of more- and less- aged pixels by decreasing the maximum luminance of infrequently-used pixels to match the maximum luminance of frequently-used pixels. Therefore, according to the invention, the effects of differential aging are rendered invisible. Method 30 may be repeated as often as is necessary, given the specific technology, usage profile, and luminance decay characteristics of the technology used.

Figure 3:
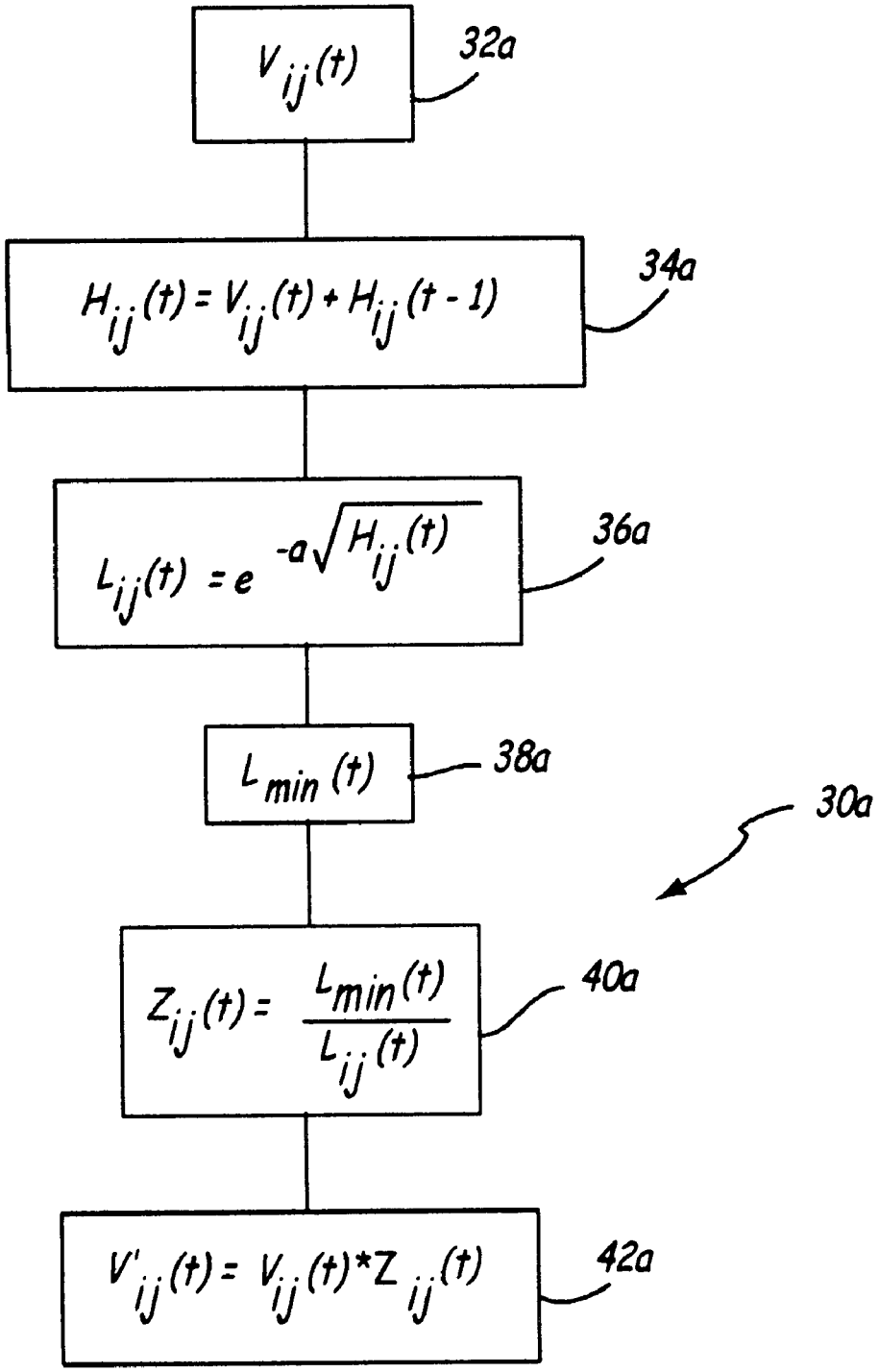
FIG. 3 is a flowchart of a method according to another embodiment of the invention.

To illustrate the use of the invention with a specific technology, consider display technologies having a decrease in luminance that is characterized as being exponential over time. FIG. 3 is a flowchart of a specific application of method 30*a* as applied to such technologies, which include OLED technology. Method 30*a* is similar to method 30, and corresponding steps will therefore be designated with similar reference numbers, with the addition of an "a" to each number (e.g., 30*a*, 32*a*, 34*a*, etc.). OLED's exhibit significant differential aging or decay according to the following equation:

$$L(t)=L(\mathbf{0})e^{-a\sqrt{t}} \quad (1),$$

where L(t) represents the maximum luminance of a pixel at a given time, L(0) is the initial pixel maximum luminance, t is the total elapsed "on" time of the pixel, and a represents a non-time dependent, device-specific constant. Equation 1 applies independently to each pixel. Since each pixel has different usage depending on its location and the images displayed, different values of t are likely for each pixel. Correspondingly, L(t) is a time- and pixel-dependent function. In most devices, initial maximum pixel luminance L(0) is nearly equal for all pixels, and can be treated as a pixel-independent constant. Therefore, the aging equation can be reformulated as a relative aging equation:

$$L'(t)=\frac{L(t)}{L(0)}=e^{-a\sqrt{t}}, \quad (2)$$

where L'(t) represents the relative maximum luminance between actual maximum luminance L(t) and initial maximum pixel luminance L(0). Each pixel's aging can now be predicted based on the constant a and the elapsed time t. The constant a varies according to display materials, design, and fabrication, but is nearly constant between pixels within a single display. Display devices with tolerably long lifetimes usually have $a \leqq 0.01$ when t is measured in hours. If it is true that L(0) and a are equal for all pixels in a given display, then the only factor that determines differential aging is t. Using equation 2 and a known value for a, the luminance of any pixel can be predicted for any elapsed time. Therefore, compensation of differential aging may be accomplished by monitoring and logging the usage history for each pixel.

According to the invention, monitoring the usage history for each pixel is performed by sampling the images presented to the display, and storing the results in a non-volatile memory. In an ideal implementation of this invention, the "on" duration for every pixel in every image would be recorded for the full lifetime of the display. In practice, this scheme would quickly require large, impractical amounts of memory. Therefore a reduced image sampling rate is required to keep the memory requirements modest. Fortunately, only images that are presented for long periods of time are concerning with respect to latent image formation, and transient images can be safely ignored. Therefore, sampling the display image at a frequency much less than the maximum possible image update rate is feasible.

For example, consider a cellular phone display that is constructed using OLED technology. A total of 10,000 monochrome pixels are arranged in a 100×100 rectangular grid. Each pixel is either "on" or "off" at any given time, which would require 1 bit to transfer information about the state of each pixel. In other words, the image displayed by the display is bi-level. Assume that the cellular phone has an 18-month lifetime before anticipated replacement. The phone is programmed to be on and in a standby mode for 16 hours per day. The phone is actively used for sending and/or receiving calls for 200 minutes per month. This may be a typical usage pattern for a cellular phone. In this situation, the total phone life equates to 8640 hours. Of this time, only 60 hours, or less than one percent, are spent actively using the phone. The remaining time is spent with the phone in "standby" mode, in which the displayed image is a static default screen. In this specific case, sampling the image once per hour would be highly accurate, since this would provide nearly 9000 samples. Therefore, sampling the image infrequently can still provide an accurate representation of pixel history. In other situations, the sampling rate would need to be optimized for the specific rate of aging, expected usage patterns, and contrast visibility of latent images.

According to the invention, the image going to the display is sampled by ascertaining the state of each pixel and placing the state of each pixel into an image matrix {V(t)}. This is shown in step 32*a* in FIG. 3. In step 34*a* the image matrix is then added to an image history matrix {H(t)}. For this simple display where images are only 1-bit deep ($V_{ij}(t)=0$, 1), simply adding the current image data into an equal-dimension matrix provides a simple means of building a history:

$$\{H(t)\}=\{V(t)\}+\{H(t-1)\} \text{ or } H_{ij}(t)=V_{ij}(t)+H_{ij}(t-1) \quad (3).$$

When the display is new, the history matrix contains zeros at all locations ($H_{ij}(t)=0$). Over time, the value at each location in the history matrix increases, with frequently used locations growing faster than other less-used locations. For the present embodiment, history matrix {H(t)} may be considered to be simply a "tally" of the elapsed "on" time for the individual pixels. The history matrix must be stored in non-volatile memory 16*a* to prevent loss of the history matrix when power is removed.

The maximum value at any matrix location is limited only by the number of bits assigned to the history matrix memory. For the current example, assume 13 bits are assigned to each location. This provides for a minimum of 8192 samples before the history file reaches saturation at any location. In actual usage the number of samples is likely to exceed this number. Since-the display in this example is 100×100 pixels, the history matrix will require 100×100×13 bits, or 130,000 bits. This matrix fits comfortably within just 16 KB of memory. The values recorded within the history matrix are integers ranging from 0 to 8191, and have dimensions of hours, since this is the sampling interval.

The recorded image history is used to modify the current image prior to it being sent to the display. As previously stated, the goal of this modification is to equalize the maximum luminance of more- and less-aged pixels by decreasing the maximum luminance of infrequently-used pixels to match the maximum luminance of frequently-used pixels. Differential aging is therefore not eliminated from the display device, but rather rendered invisible. This pixel-by-pixel luminance correction is performed by first using history matrix {H(t)} to create a luminance decay matrix {L(t)} after a predetermined number of samples have been taken. Since the individual history matrix entries $H_{ij}(t)$ represent total elapsed "on" time for the pixels, the individual matrix elements can be used to calculate pixel-by-pixel luminance decay, as indicated by step 36*a*, using equation 2:

$$L_{ij}(t) = e^{-a\sqrt{H_{ij}(t)}} \tag{4}$$

The results of these calculations are stored in memory 16, and may be stored in volatile memory 16*b* since the luminance decay matrix can be recalculated if lost. Since equation 4 requires floating point calculations, at least 16 bits will be assigned to each matrix element to ensure accurate results. The values recorded in the luminance decay matrix are fractional numbers ranging from 0 to 1. The lowest value stored in luminance decay matrix {L(t)} is detected in step 38*a* and recorded in memory 16 as the lowest maximum luminance value $L_{min}(t)$. In the present example, the memory requirement for the luminance decay matrix is an additional 20 KB, bringing the total to 36 KB.

Using luminance decay matrix {L(t)}, and lowest maximum luminance value $L_{min}(t)$, a correction matrix {Z(t)} is computed in step 40*a:*

$$\{Z(t)\}=L_{min}(t)/\{L(t)\} \text{ or } Z_{ij}(t)=L_{min}(t)/L_{ij}(t) \tag{5}$$

Correction matrix {Z(t)} is stored in memory 16, and may be stored in volatile memory 16*b* because the correction matrix can easily be recalculated if lost. Equation 5 also requires floating point calculations, using at least 16 bits per matrix element. The values recorded in the correction matrix are fractional numbers ranging from 0 to 1. In the present example, the memory requirement for correction matrix {Z(t)} is an additional 20 KB, bringing the size of the total required memory to 56 KB.

Finally, in step 42*a* a corrected image matrix {V'(t)} is generated by performing a vectorized multiplication of image matrix {V(t)}, representing the original image, and correction matrix {Z(t)}:

$$\{V'(t)\}=\{V(t)\}*\{Z(t)\} \text{ or } V'_{ij}(t)=V_{ij}(t)*Z_{ij}(t) \tag{6}$$

This multiplication is done in real-time just prior to sending the corrected image data to the display.

Since differential aging is a relatively slow phenomenon, the correction matrix may be calculated at a slower rate than the history file update. The correction matrix can be updated at $1/10^{th}$ to $1/100^{th}$ the rate at which the history file is updated, depending upon the expected rate of luminance decay and the desired performance of the correction.

Methods 30 and 30*a* may be varied in many ways. For instance, the methods may be extended to more complicated displays, with corresponding increases in complexity of implementation and in the size of required memory. Increasing display resolution increases memory requirements linearly with total number of pixels. Changing from monochrome to a full-color display would increase the required memory by a factor of three. Changing from bi-level to grayscale images increases memory size in a linear fashion depending on image bit depth. Grayscale images would also require more complicated luminance decay equations. Increasing the sampling rate increases the storage requirements linearly. Finally, increasing the expected device lifetime increases storage requirements linearly.

If applied to a grayscale display, the adjustments to maximum luminance remain the same as previously described. After adjusting the maximum luminance to account for age-related decay, the grayscale range between maximum and minimum luminance is divided into steps as desired. For example, the luminance range can be divided into linear, equal steps. Commonly there are eight or more equal-luminance steps between the maximum and the minimum luminance. When significant aging has occurred, the luminance interval between adjacent grayscale levels decreases such that the number of steps is preserved within the reduced total range of luminance between maximum and minimum luminance values. After adjusting the maximum luminance of each pixel to account for aging as previously described, the intermediate grayscale luminances for all pixels are once again uniform.

High-resolution displays may require or be benefited by sophisticated sampling techniques and date compression. It is not intended for the simple OLED example described in detail above to limit the application of such techniques. Indeed, it is anticipated that the invention may be used with any suitable sampling and compression algorithms in connection with the history matrix creation and storage.

The technique described above is also applicable to other display media that have predictable luminance decay characteristics. Technologies such as CRT, field emission displays (FED), plasma display panels (PDP), thin film electroluminescent displays (TFEL), inorganic LED, and polymer LED have luminance decay curves that are exponentially-decreasing (as discussed with OLED above), although decay rates vary significantly between display devices and media. The invention may also be used with technologies that do not exhibit exponential decay characteristics.

An advantage of the invention is that the effects of differential aging may be substantially eliminated.

Another advantage of the invention is that the invention may be adjusted for use on a wide variety of display technologies, regardless of whether the decay characteristic of the display is exponential or non-exponential.

Still another advantage is that a minimum amount of memory is required to store the required parameters and matrices. Only a fraction of the required memory needs to be non-volatile. This lessens the cost of using the invention.

Yet another advantage is that the invention uses components that are traditionally already included with display systems. Because no special components are required, the cost of using the invention is further lessened.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. A method of compensating for differential aging of independent emitters in a display, wherein each independent emitter has a maximum luminance that decays with use, comprising:

periodically sampling an image to determine how often each independent emitter is used;

compiling a history of use of each independent emitter for a predetermined time;

estimating how much luminance decay that each independent emitter has experienced over the predetermined time; and adjusting the maximum luminance of each independent emitter so that the maximum luminances of all of the independent emitters is substantially the same as the maximum luminance of the independent emitter that has experienced the most decay.

2. The method of claim 1, further including:

determining which independent emitter has experienced the most estimated decay; and calculating how much the luminance of each of the independent emitters is to be adjusted by comparing the estimated decay of each of the independent emitters to the decay of the independent emitter that has experienced the most estimated decay.

3. The method of claim 1, wherein the luminance decay of each independent emitter is estimated in part by assuming that the luminance decay progresses exponentially.

4. The method of claim 1, wherein the history is compiled by storing the history in a non-volatile memory, and periodically updating the history by adding the sampled image to the history, thereby creating a record of accumulated use for each independent emitter.

5. The method of claim 4, wherein the history is stored in a matrix within the memory, the matrix having an entry for each independent emitter.

6. The method of claim 1, wherein the luminance decay $L_{ij}(t)$ for each independent emitter is estimated by $$L_{ij}(t) = e^{-a\sqrt{H_{ij}(t)}},$$

where $H_{ij}(t)$ is the compiled history of use of each independent emitter at the predetermined time, and a represents time-independent decay characteristics of the independent emitter.

7. The method of claim 1, wherein each independent emitter emits one of a plurality of colors, and wherein the estimating and adjusting steps are performed independently for each of the plurality of colors.

8. A method of reducing the visibility of latent images on a display, the display having a plurality of independently controllable pixels, wherein each pixel has a maximum luminance that decays over time, the method comprising:

attaching a controller to the display, wherein the controller is configured to receive display image data, the controller being further configured to control the luminance of each pixel based on a desired image;

periodically sampling the display image data to determine whether each pixel is being used;

storing a usage history of each pixel in a memory, wherein the usage history comprises the results of a plurality of periodic samples of the display image data;

after a predetermined number of samplings, estimating the luminance decay of each pixel based at least in part on the usage history of each pixel; and adjusting the maximum luminance of each pixel so that the maximum luminances of the plurality of pixels appear to have equal age-related decay.

9. The method of claim 8, further including:

determining which pixel has experienced the most luminance decay; and adjusting the maximum luminance of each pixel so that each pixel has substantially the same maximum luminance as the pixel that has experienced the most luminance decay.

10. The method of claim 8, wherein the luminance decay of each pixel is estimated by assuming that the maximum luminance of each pixel decays exponentially.

11. The method of claim 10, wherein the luminance decay of each pixel is estimated using the following function:

$$e^{-a\sqrt{H_{ij}(t)}},$$

where $H_{ij}(t)$ is the usage history of each pixel at the predetermined time, and a represents time-independent decay characteristics of each pixel.

* * * * *